US011674515B2

(12) United States Patent
Araki et al.

(10) Patent No.: US 11,674,515 B2
(45) Date of Patent: Jun. 13, 2023

(54) SCROLL COMPRESSOR INCLUDING AN OIL SEPARATION MEMBER

(71) Applicant: DAIKIN INDUSTRIES, LTD., Osaka (JP)

(72) Inventors: Kousuke Araki, Osaka (JP); Yoshitomo Tsuka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/845,574

(22) Filed: Jun. 21, 2022

(65) Prior Publication Data

US 2022/0316479 A1 Oct. 6, 2022

Related U.S. Application Data

(63) Continuation of application No. PCT/JP2021/002573, filed on Jan. 26, 2021.

(30) Foreign Application Priority Data

Jan. 31, 2020 (JP) ..... JP2020-015238

(51) Int. Cl.
*F04C 29/02* (2006.01)
*F04C 18/02* (2006.01)
*F04C 23/00* (2006.01)

(52) U.S. Cl.
CPC ..... *F04C 29/026* (2013.01); *F04C 18/0215* (2013.01); *F04C 23/008* (2013.01); (Continued)

(58) Field of Classification Search
CPC .. F04C 29/026; F04C 18/0215; F04C 23/008; F04C 29/023; F04C 2240/30; F04C 2240/40
See application file for complete search history.

(56) References Cited

U.S. PATENT DOCUMENTS 4,621,993 A * 11/1986 Nakamura ..... F04C 29/028 418/94
2013/0052069 A1* 2/2013 Iitsuka ..... F04C 23/008 418/55.1

FOREIGN PATENT DOCUMENTS

CN 101936292 A * 1/2011
CN 202441599 A 9/2012
(Continued)

OTHER PUBLICATIONS

English Machine Translation of JP2012-202253A (Year: 2012).*
(Continued)

*Primary Examiner* — Dominick L Plakkoottam
*Assistant Examiner* — Paul W Thiede
(74) *Attorney, Agent, or Firm* — Global IP Counselors, LLP

(57) ABSTRACT

A scroll compressor includes a casing, a scroll compression mechanism, a motor, a crankshaft, a bearing, a frame fixed to the casing; and an oil separation member fixed to the frame. The motor includes a stator and a rotor rotatable in a rotational direction. The bearing rotatably supports the crankshaft. The oil separation member suppresses mixing of a refrigerant and a lubricating oil. The frame supports the bearing and has first and second fixed legs fixed to the casing. The oil separation member has a first horizontal and inclined surfaces. The first inclined surface has a first inclined surface upstream portion and a first inclined surface downstream portion. The first inclined surface downstream portion is disposed higher than the first inclined surface upstream portion. The first horizontal surface, the first inclined surface, and the first fixed leg are disposed in order from upstream to downstream in the rotational direction.

19 Claims, 5 Drawing Sheets

(52) U.S. Cl.
CPC ..... *F04C 29/023* (2013.01); *F04C 2240/30* (2013.01); *F04C 2240/40* (2013.01)

(56) References Cited

FOREIGN PATENT DOCUMENTS

| | | | | | |
|---|---|---|---|---|---|
| CN | 106922163 | A | | 7/2017 | |
| JP | 3-47496 | A | | 2/1991 | |
| JP | 4-72998 | A | | 11/1992 | |
| JP | 2012-202253 | A | | 10/2012 | |
| JP | 2012202253 | A | * | 10/2012 | |
| JP | 2013047481 | A | * | 3/2013 | ..... F04C 18/0215 |
| JP | 2015-105637 | A | | 6/2015 | |
| JP | 2015105638 | A | * | 6/2015 | |

OTHER PUBLICATIONS

International Preliminary Report of corresponding PCT Application No. PCT/JP2021/002573 dated Aug. 11, 2022.
International Search Report of corresponding PCT Application No. PCT/JP2021/002573 dated Apr. 6, 2021.
European Search Report of corresponding EP Application No. 21 74 7932.8 dated Apr. 24, 2023.

* cited by examiner

SCROLL COMPRESSOR INCLUDING AN OIL SEPARATION MEMBER

CROSS-REFERENCE TO RELATED APPLICATIONS

This is a continuation of International Application No. PCT/JP2021/002573 filed on Jan. 26, 2021, which claims priority to Japanese Patent Application No. 2020-015238, filed on Jan. 31, 2020. The entire disclosures of these applications are incorporated by reference herein.

BACKGROUND

Technical Field

The present disclosure relates to a scroll compressor including an oil separation member that separates refrigerant from oil.

Background Art

A scroll compressor disclosed in JP 2015-105637 A includes an oil separation plate. The oil separation plate suppresses scattering of lubricating oil that can be caused by a refrigerant gas contacting an oil reservoir. The oil separation plate is fixed to a lower bearing member. The lower bearing member has three legs. The three legs are fixed to an inner peripheral face of a casing.

A refrigerant discharged from a compression mechanism contains the lubricating oil. The refrigerant then moves to near the lower bearing member. There, the refrigerant receives a force from a rotating rotor and swirls in a circumferential direction of the casing along the oil separation plate. As the refrigerant swirls, the lubricating oil is separated from the refrigerant by cyclone separation.

SUMMARY

A scroll compressor according to a first aspect includes a casing, a scroll compression mechanism disposed in the casing, a motor disposed in the casing below the scroll compression mechanism, a crankshaft connecting the scroll compression mechanism and the motor, a bearing disposed below the motor, a frame fixed to the casing; and an oil separation member fixed to the frame. The motor includes a stator and a rotor rotatable in a rotational direction. The bearing rotatably supports the crankshaft. The oil separation member is configured to suppress mixing of a refrigerant and a lubricating oil in the casing. The frame supports the bearing. The frame has a first fixed leg fixed to the casing and a second fixed leg fixed to the casing. The oil separation member has a first horizontal surface and a first inclined surface. The first inclined surface has a first inclined surface upstream portion and a first inclined surface downstream portion in the rotational direction. The first inclined surface downstream portion is disposed higher than the first inclined surface upstream portion. The first horizontal surface, the first inclined surface, and the first fixed leg are disposed in order from upstream to downstream in the rotational direction.

In this configuration, a swirling flow of the refrigerant advances obliquely upward by the first inclined surface, and then approaches the first fixed leg. Therefore, the swirling flow of the refrigerant is prevented from colliding with first fixed leg.

DETAILED DESCRIPTION OF EMBODIMENT(S)

Basic Embodiment (1) Overall Configuration

Figure 1:
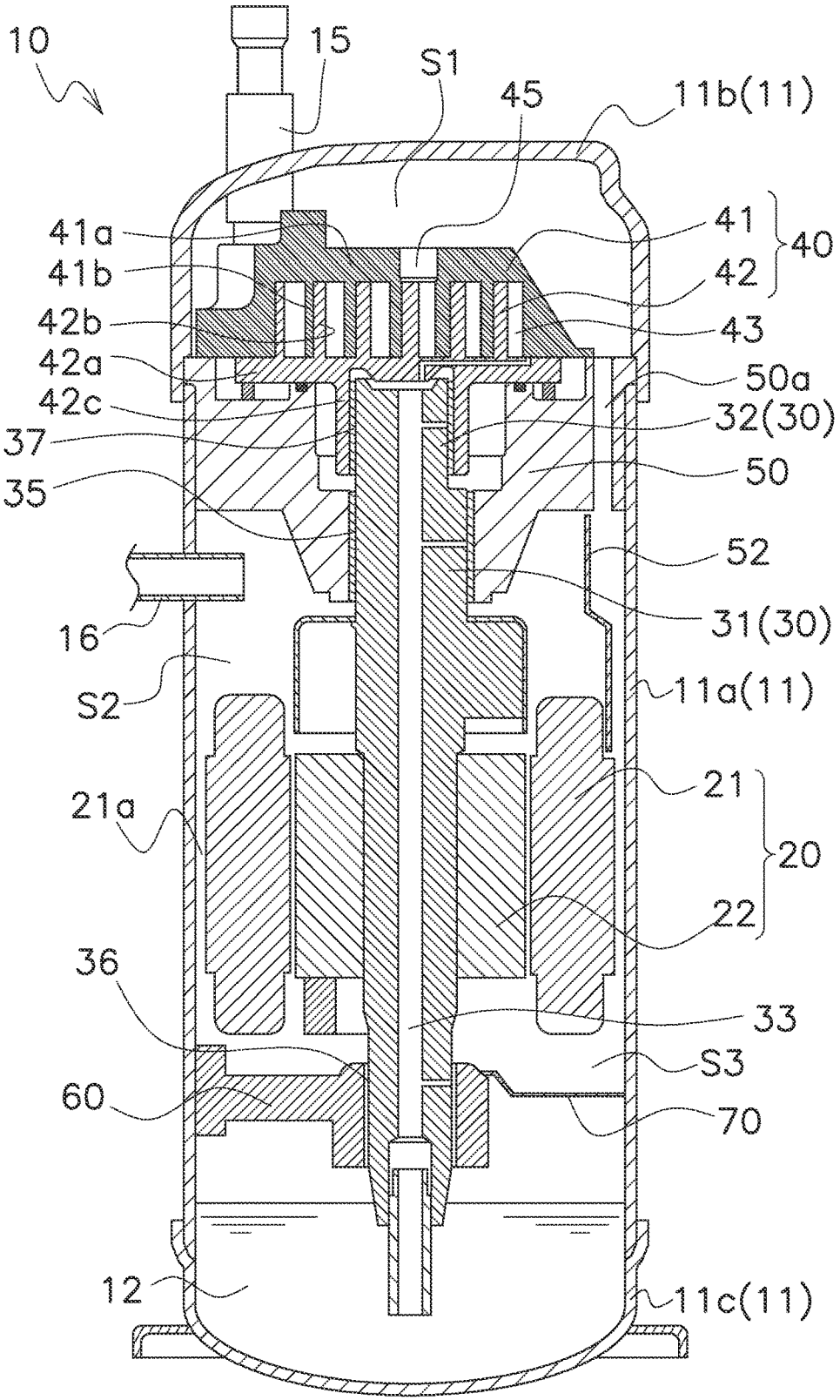
FIG. 1 is a sectional view of a scroll compressor 10 according to a basic embodiment.

FIG. 1 is a sectional view of a scroll compressor 10 according to a basic embodiment. The scroll compressor 10 compresses a low-pressure refrigerant as a fluid to generate a high-pressure refrigerant. The scroll compressor 10 includes a casing 11, a motor 20, a crankshaft 30, a scroll compression mechanism 40, an upper frame 50, a lower frame 60, an oil separation member 70, an oil guide 51 (FIG. 2), and a refrigerant guide 52 (FIG. 3).

(2) Detailed Configurations (2-1) Casing 11

As illustrated in FIG. 1, the casing 11 accommodates various components of the scroll compressor 10. The casing 11 includes a barrel 11*a*, an upper portion 11*b*, and a lower portion 11*c*. The barrel 11*a* has a substantially cylindrical shape. The upper portion 11*b* and the lower portion 11*c* are airtightly joined to the barrel 11*a*. The upper portion 11*b* is provided with a suction pipe 15. The barrel 11*a* is provided with a discharge pipe 16. An oil reservoir 12 that stores lubricating oil is provided near the lower portion 11*c*.

(2-2) Motor 20

The motor 20 generates power for driving the scroll compression mechanism 40. The motor 20 is disposed in the casing 11. The motor 20 is disposed below the scroll compression mechanism 40. The motor 20 includes a stator 21 and a rotor 22.

The stator 21 includes coils (not illustrated). The coils convert power received by the scroll compressor 10 into magnetic force. The stator 21 has a substantially cylindrical shape. The stator 21 is fixed to the barrel 11*a*. The stator 21 has on its outer periphery a notch called a core cut 21*a*. A gap formed by the core cut 21*a* between the barrel 11*a* and the stator 21 functions as a passage for the refrigerant.

The rotor 22 is disposed near the stator 21. The rotor 22 includes a permanent magnet (not illustrated). The rotor 22 has a substantially cylindrical shape. The coils of the stator 21 and the permanent magnet of the rotor 22 interact with each other to rotate the rotor 22.

(2-3) Crankshaft 30

The crankshaft 30 transmits power generated by the motor 20 to the scroll compression mechanism 40. The crankshaft 30 connects the scroll compression mechanism 40 and the motor 20. The crankshaft 30 is fixed to the rotor 22. The crankshaft 30 has a concentric portion 31 and an eccentric portion 32. The concentric portion 31 is concentric with an axis of the rotor 22 and the crankshaft 30. The eccentric portion 32 is eccentric from the axis. The concentric portion 31 is rotatably supported by an upper bearing 35 and a lower bearing 36. The eccentric portion 32 is rotatably supported by an eccentric bearing 37. The upper bearing 35 is disposed above the motor 20. The lower bearing 36 is disposed below the motor 20. The eccentric bearing 37 is disposed near the scroll compression mechanism 40.

An oil ascending hole 33 is provided inside the crankshaft 30. As the crankshaft 30 rotates, the lubricating oil in the oil reservoir 12 is sucked up into the oil ascending hole 33 and then supplied to the scroll compression mechanism 40, the upper bearing 35, the lower bearing 36, and the eccentric bearing 37.

(2-4) Scroll Compression Mechanism 40

The scroll compression mechanism 40 is disposed in the casing 11. The scroll compression mechanism 40 includes a fixed scroll 41 and a movable scroll 42.

The fixed scroll 41 includes a fixed plate 41*a* and a fixed wrap 41*b*. The fixed plate 41*a* is a part extending in a horizontal direction. The fixed wrap 41*b* extends in a vertical direction from the fixed plate 41*a*. The fixed wrap 41*b* has a spiral shape in plan view. A discharge hole 45 for discharging a high-pressure refrigerant is formed at a center of the fixed plate 41*a*.

The movable scroll 42 includes a movable plate 42*a*, a movable wrap 42*b*, and a movable protrusion 42*c*, The movable plate 42*a* is a part extending in the horizontal direction. The movable wrap 42*b* extends in the vertical direction from the movable plate 42*a*. The movable wrap 42*b* has a spiral shape in plan view. The movable protrusion 42*c* extends in the vertical direction from the movable plate 42*a*. The movable protrusion 42*c* has a concave portion. The concave portion accommodates the eccentric bearing 37 and the eccentric portion 32. The movable scroll 42 can revolve around the fixed scroll 41.

The fixed scroll 41 and the movable scroll 42 together define a plurality of compression chambers 43. The compression chamber 43 at an outermost position communicates with the suction pipe 15.

(2-5) Upper Frame 50

The upper frame 50 supports the upper bearing 35. The upper frame 50 supports the crankshaft 30 via the upper bearing 35. The upper frame 50 is fixed to the barrel 11*a* of the casing 11. The fixed scroll 41 is fixed to the upper frame 50. The upper frame 50 is provided with a refrigerant passage 50*a* vertically penetrating the upper frame 50.

(2-6) Lower Frame 60

The lower frame 60 supports the lower bearing 36. The lower frame 60 supports the crankshaft 30 via the lower bearing 36. The lower frame 60 is fixed to the barrel 11*a* of the casing 11.

(2-7) Oil Separation Member 70

The oil separation member 70 suppresses mixing of the refrigerant and the lubricating oil. That is, the oil separation member 70 suppresses scattering of the lubricating oil that may be caused by the gas refrigerant contacting the oil reservoir 12, and thus suppresses mixing of the refrigerant and the lubricating oil. The oil separation member 70 is fixed to the lower frame 60.

(2-8) Oil Guide 51

Figure 2:
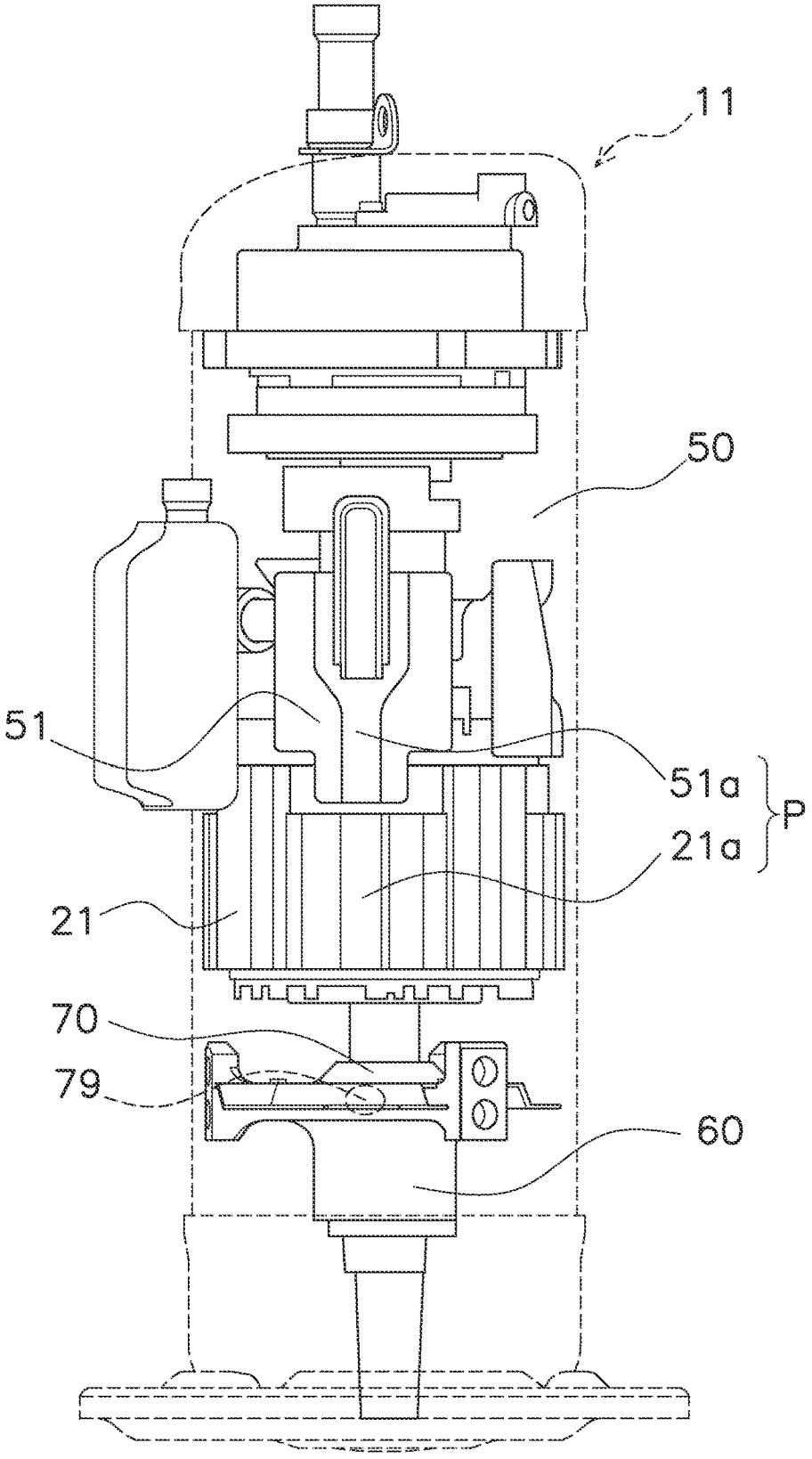
FIG. 2 is a side view of some components of the scroll compressor 10.
Figure 3:
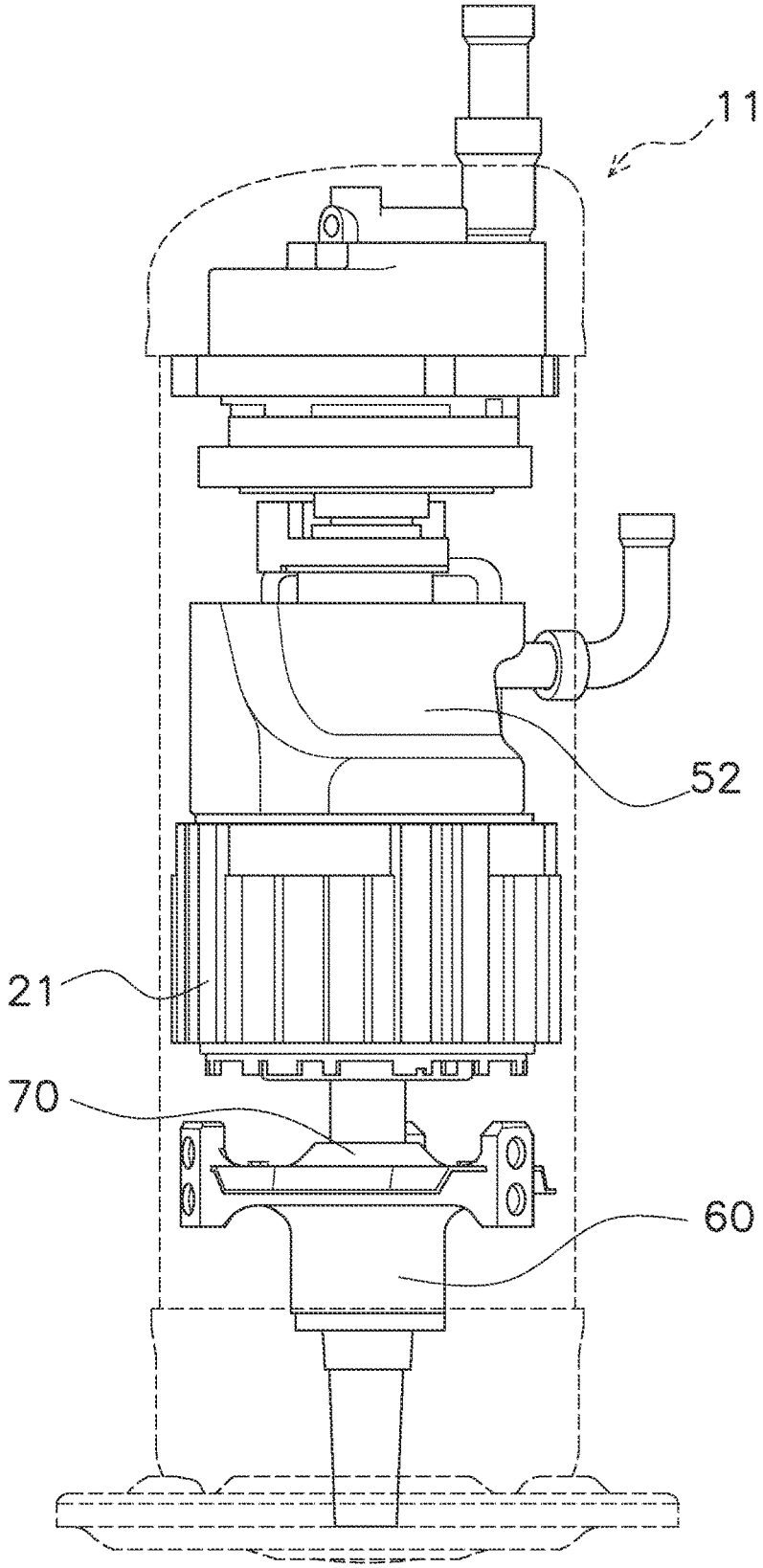
FIG. 3 is a side view of some components of the scroll compressor 10.

FIG. 2 is a side view of some components of the scroll compressor 10. The oil guide 51 is provided on the barrel 11*a* of the casing 11. The oil guide 51 is provided with a groove 51*a*. The groove 51*a* guides the lubricating oil located above downward. The groove 51*a* of the oil guide 51 and the core cut 21*a* of the stator 21 constitute an oil return passage P. The oil return passage P guides the lubricating oil from above the motor 20 to below the motor 20. The lubricating oil located above the oil guide 51 passes through the oil return passage P and then falls to an oil return passage portion 79 of the oil separation member 70. The oil return passage portion 79 is located immediately below the oil return passage P.

(2-9) Refrigerant Guide 52

FIG. 3 is a side view of some components of the scroll compressor 10. The refrigerant guide 52 is provided on the barrel 11*a* of the casing 11. The refrigerant guide 52 guides the refrigerant located above in a circumferential direction and downward. As a result, part of the refrigerant swirls along an inner peripheral surface of the barrel 11*a* while advancing in the horizontal direction. Another part of the refrigerant advances downward and passes through the core cut 21*a*.

(3) Movements of Refrigerant and Lubricating Oil

Movements of the refrigerant and the lubricating oil will be described below. It should be noted that the refrigerant and the lubricating oil do not move completely independently of each other. The refrigerant and the lubricating oil exhibit compatibility. Thus, the movement of the refrigerant or the lubricating oil discussed below may also be movement of a mixture of the refrigerant and lubricating oil.

(3-1) Refrigerant

The low-pressure refrigerant enters the scroll compressor 10 from the suction pipe 15 illustrated in FIG. 1. The low-pressure refrigerant then enters the compression chamber 43 at the outermost position of the scroll compression mechanism 40. When the rotation of the crankshaft 30 revolves the movable scroll 42, the compression chamber 43 moves to a center of the scroll compression mechanism 40 while reducing the volume. In this process, the low-pressure refrigerant is compressed to become a high-pressure refrigerant. The high-pressure refrigerant exits from the discharge hole 45 to an upper space S1. Thereafter, the high-pressure refrigerant reaches a middle space S2 by passing through the refrigerant passage 50*a* of the upper frame 50. The high-pressure refrigerant then reaches the refrigerant guide 52.

The refrigerant guide 52 allows part of the refrigerant to swirl along an inner periphery of the barrel 11*a* while advancing in the horizontal direction. This swirling flow may be further accelerated by the rotation of the rotor 22. Another part of the refrigerant advances downward, passes through the core cut 21*a*, and collides with the oil separation member 70. Next, in a lower space S3 between the motor 20 and the lower frame 60, the rotation of the rotor 22 swirls the refrigerant.

(3-2) Lubricating Oil

The lubricating oil is sucked up from the oil reservoir 12 to the oil ascending hole 33. Thereafter, the lubricating oil is supplied to the scroll compression mechanism 40, the upper bearing 35, the lower bearing 36, and the eccentric bearing 37. Subsequently, the lubricating oil exits the scroll compression mechanism 40, the upper bearing 35, the lower bearing 36, and the eccentric bearing 37. Next, the lubricating oil moves downward along the inner peripheral surface of the barrel 11*a* or the oil return passage P of the oil guide 51. The lubricating oil having exited the oil return passage P falls from the core cut 21*a* to the oil return passage portion 79 of the oil separation member 70.

(4) Detailed Structure of Lower Frame 60 and Oil Separation Member 70

Figure 4:
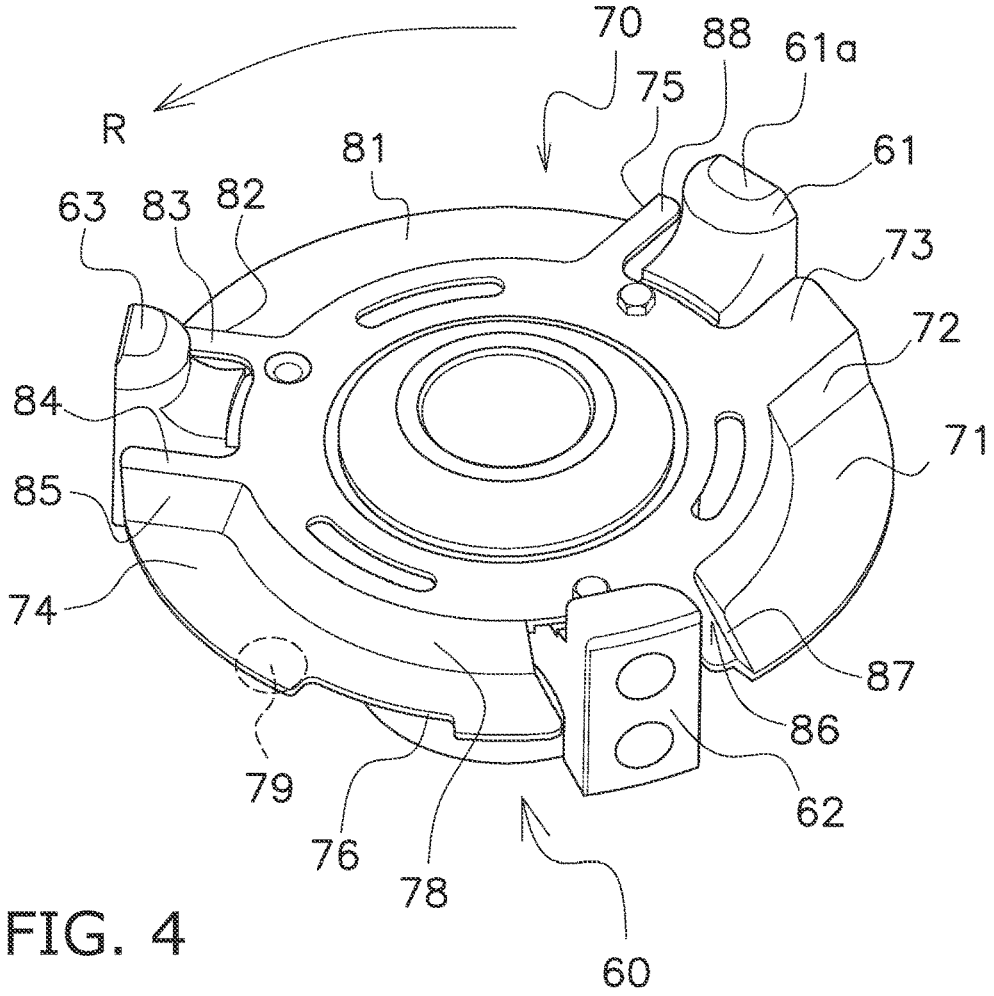
FIG. 4 is a perspective view of a lower frame 60 and an oil separation member 70.

FIG. 4 is a perspective view of the lower frame 60 and the oil separation member 70. An arrow in the drawing indicates a rotational direction R of the rotor 22.

The lower frame 60 includes a first fixed leg 61, a second fixed leg 62, and a third fixed leg 63. The first fixed leg 61, the second fixed leg 62, and the third fixed leg 63 are all fixed to the barrel 11*a* of the casing 11. A method of fixing is, for example, welding. The first fixed leg 61 has a first fixed leg upper surface 61*a*.

The oil separation member 70 is a plate-shaped member fixed to the lower frame 60. A first horizontal surface 71, a second horizontal surface 73, a third horizontal surface 74, a fourth horizontal surface 81, a fifth horizontal surface 83, a sixth horizontal surface 84, a seventh horizontal surface 86, an eighth horizontal surface 88, a first inclined surface 72, a second inclined surface 75, a third inclined surface 82, a fourth inclined surface 85, a fifth inclined surface 87, and a notch 76 are formed at a position close to an outer periphery of the oil separation member 70. The notch 76 allows the lubricating oil accumulated on the oil separation member 70 to fall into the oil reservoir 12.

The first horizontal surface 71, the first inclined surface 72, the second horizontal surface 73, the first fixed leg 61, and the second inclined surface 75 are disposed in that order from upstream to downstream in the rotational direction R. The third horizontal surface 74 and the second fixed leg 62 are disposed in that order from upstream to downstream in the rotational direction R.

Figure 5:
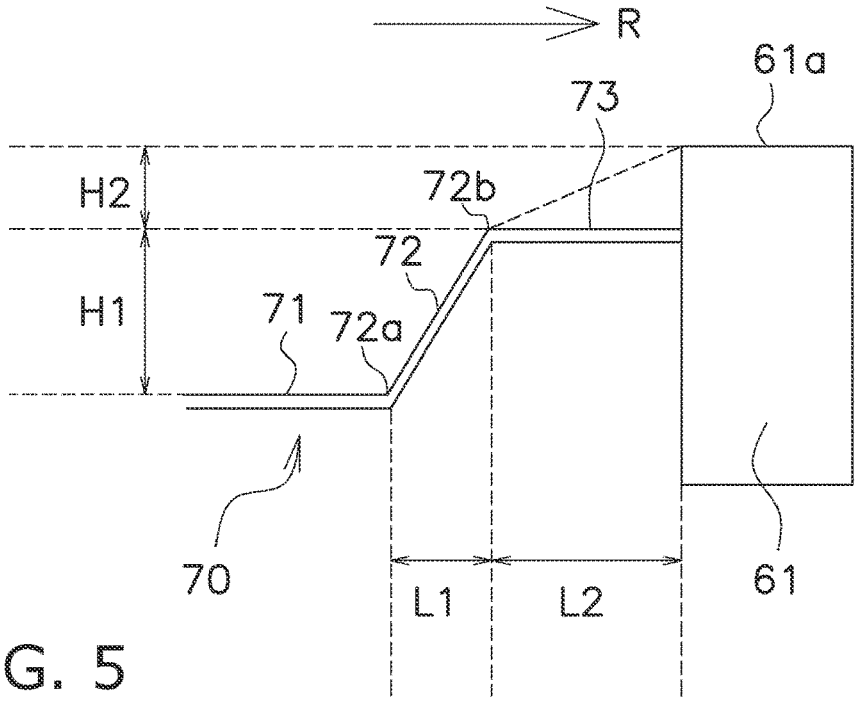
FIG. 5 is a schematic diagram of the oil separation member 70 as viewed from an outer periphery.

FIG. 5 is a schematic diagram of a periphery of the first inclined surface 72. An upstream side of the first inclined surface 72 is a first inclined surface upstream portion 72*a*. A downstream side of the first inclined surface 72 is a first inclined surface downstream portion 72*b*. The first inclined surface downstream portion 72*b* is disposed higher than the first inclined surface upstream portion 72*a*.

The first inclined surface upstream portion 72*a* and the first inclined surface downstream portion 72*b* are separated from each other by a first height difference H1. The first inclined surface upstream portion 72*a* and the first inclined surface downstream portion 72*b* are separated from each other in the circumferential direction by a first circumferential distance L1. The second horizontal surface 73 and the first fixed leg upper surface 61*a* are separated from each other by a second height difference H2. The second horizontal surface 73 extends in the circumferential direction by a second circumferential distance L2.

A ratio of the first height difference H1 to the first circumferential distance L1 is a first inclination H1/L1. A ratio of the second height difference H2 to the second circumferential distance L2 is a second inclination H2/L2. The first inclination H1/L1 is larger than the second inclination H2/L2. The first inclination H1/L1 is 0.5 or more and 2.0 or less. The second inclination H2/L2 is 0.3 or more and 1.0 or less.

Figure 6:
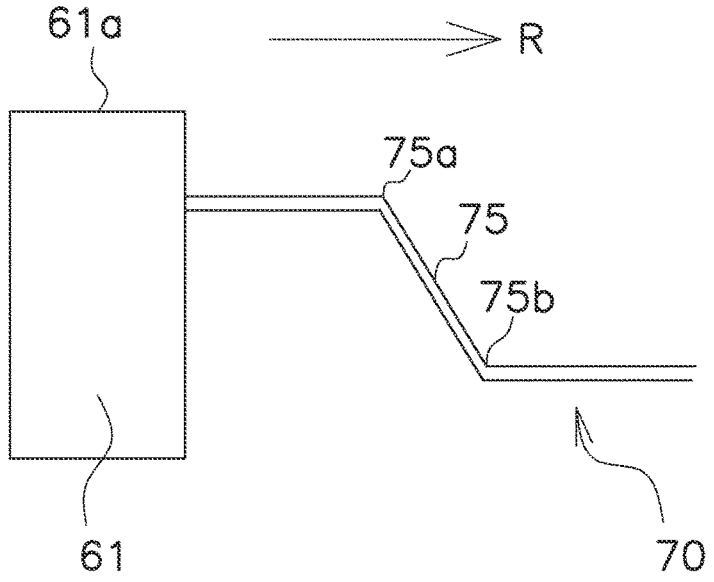
FIG. 6 is a schematic diagram of the oil separation member 70 as viewed from the outer periphery.

FIG. 6 is a schematic diagram of a periphery of the second inclined surface 75. An upstream side of the second inclined surface 75 is a second inclined surface upstream portion 75*a*. A downstream side of the second inclined surface 75 is a second inclined surface downstream portion 75*b*. The second inclined surface downstream portion 75*b* is disposed lower than the second inclined surface upstream portion 75*a*.

Returning to FIG. 4, a third inclined surface 78 is formed on the oil separation member 70. The third inclined surface 78 is inclined in a cross section in a radial direction of the oil separation member 70. The third inclined surface 78 is high on an inner side in the radial direction and low on an outer side in the radial direction.

The circumferential distance L2 of the second horizontal surface 73 is set to be larger than the circumferential distance of the fifth horizontal surface 83. This is because the first horizontal surface 71 located upstream of the second horizontal surface 73 is located below the refrigerant guide 52. The first horizontal surface 71 receives a strong refrigerant flow blown downward from the refrigerant guide 52.

(5) Characteristics

In a general compressor without the structure according to the above-mentioned embodiment, the refrigerant swirling in the circumferential direction of the casing along the oil separation plate may contact the legs of the lower bearing member. At this time, swirling of the refrigerant is stopped, and separation of the lubricating oil from the refrigerant is inhibited in this case, a phenomenon called "oil loss" occurs more significantly in which the refrigerant is discharged to outside of the scroll compressor while containing the lubricating oil. As a result, an amount of the lubricating oil in the scroll compressor may be insufficient.

(5-1)

According to the above-mentioned embodiment, the swirling flow of the refrigerant in the lower space S3 advances obliquely upward by the first inclined surface 72, and then approaches the first fixed leg 61. Therefore, the swirling flow of the refrigerant is prevented from colliding with the first fixed leg 61. As a result, since cyclone separation of the swirling flow is less likely to be inhibited, the lubricating oil contained in the refrigerant is likely to be separated from the refrigerant. The separated lubricating oil can return to the oil reservoir 12.

(5-2)

The oil separation member 70 has the third horizontal surface 74. Therefore, the oil separation member 70 can be more easily manufactured than in a case where an inclined surface is formed at a place where the third horizontal surface 74 is to be provided.

(5-3)

The refrigerant swirling along the third horizontal surface 74 in the lower space S3 collides with the second fixed leg 62. Therefore, since the lubricating oil falling into the oil return passage portion 79 is blocked by the second fixed leg 62, the lubricating oil passes through the notch 76 and appropriately falls into the oil reservoir 12.

(5-4)

The oil return passage P includes the core cut 21*a*. Therefore, a dedicated member constituting the oil return passage P is not required at a height of the motor 20.

(5-5)

The first inclination H1/L1 is larger than the second inclination H2/L2. Therefore, since an advancing direction of the refrigerant flow is set obliquely upward by the first inclined surface 72, the refrigerant flow can be prevented from colliding with the first fixed leg 61.

(5-6)

The second inclined surface 75 having an inclination opposite to an inclination of the first inclined surface 72 is provided downstream of the first fixed leg 61. Therefore, a structure of the oil separation member 70 can be simplified.

(5-7)

The oil separation member 70 has the third inclined surface 78 which is an inclination in the radial direction. Therefore, a level difference formed by the first horizontal surface 71 and the second horizontal surface 73 is absorbed by the third inclined surface 78.

(6) Modifications

The following are modifications of the basic embodiment. For example, a plurality of modifications may be combined.

(6-1) Modification A

Figure 7:
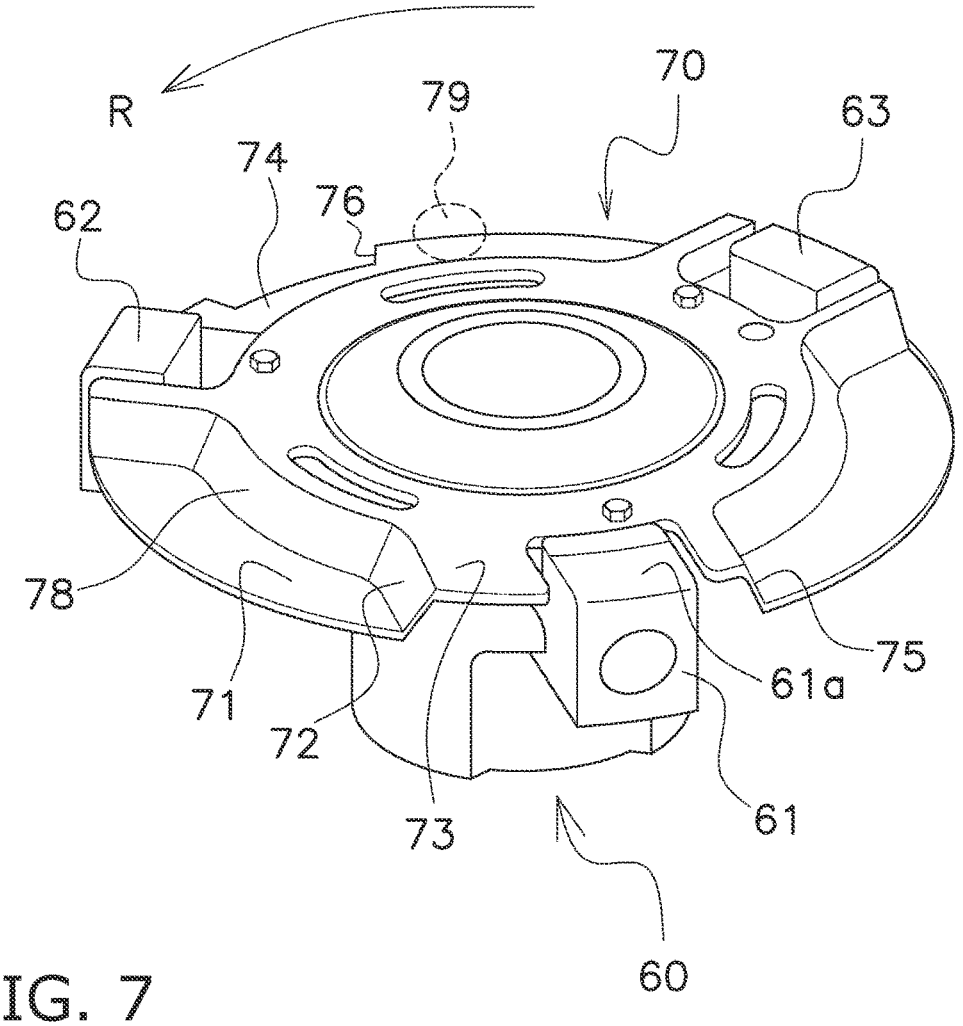
FIG. 7 is a perspective view of a lower frame 60 and an oil separation member 70 according to a modification.

FIG. 7 is Modification A of the basic embodiment. A configuration of Modification A is different from the configuration of the basic embodiment illustrated in FIG. 4 in that the first fixed leg 61, the second fixed leg 62, and the third fixed leg 63 do not protrude above the oil separation member 70. Therefore, upper surfaces of the first fixed leg 61, the second fixed leg 62, and the third fixed leg 63 (for example, the first fixed leg upper surface 61*a*) and the second horizontal surface 73 are located at substantially the same height.

This configuration also prevents the swirling flow of the refrigerant in the lower space S3 from colliding with the first fixed leg 61, the second fixed leg 62, and the third fixed leg 63.

(6-2) Modification B

In the basic embodiment, the lower frame 60 has three fixed legs. Alternatively, the number of fixed legs included in the lower frame 60 may be a number other than 3, such as 2, 4, 5, or 6.

CONCLUSION

The embodiment of the present disclosure has been described above, but it will be understood that various changes to forms and details can be made without departing from the gist and scope of the present disclosure as set forth in the claims.

The invention claimed is:

1. A scroll compressor comprising:

a casing;

a scroll compression mechanism disposed in the casing;

a motor disposed in the casing below the scroll compression mechanism, the motor including a stator and a rotor rotatable in a rotational direction;

a crankshaft connecting the scroll compression mechanism and the motor;

a bearing disposed below the motor, the bearing rotatably supporting the crankshaft;

a frame fixed to the casing, the frame supporting the bearing; and an oil separation member fixed to the frame, the oil separation member being configured to suppress mixing of a refrigerant and a lubricating oil in the casing, the frame having a first fixed leg fixed to the casing and a second fixed leg fixed to the casing, the oil separation member having a first horizontal surface, a second horizontal surface, and a first inclined surface disposed between the first horizontal surface and the second horizontal surface, the first horizontal surface and the second horizontal surface being spaced apart by a first circumferential distance in a circumferential direction of the oil separation member, the first inclined surface having a first inclined surface upstream portion and a first inclined surface downstream portion in the rotational direction, the first inclined surface downstream portion being disposed higher than the first inclined surface upstream portion, and the first horizontal surface, the first inclined surface, and the first fixed leg being disposed in order from upstream to downstream in the rotational direction.

2. The scroll compressor according to claim 1, wherein the first horizontal surface, the first inclined surface, the second horizontal surface, and the first fixed leg are disposed in order from upstream to downstream in the rotational direction.

3. The scroll compressor according to claim 2, wherein the oil separation member further has a second inclined surface, the second inclined surface has a second inclined surface upstream portion and a second inclined surface downstream portion in the rotational direction, the second inclined surface downstream portion is disposed lower than the second inclined surface upstream portion, and the first fixed leg and the second inclined surface are disposed in order from upstream to downstream in the rotational direction.

4. The scroll compressor according to claim 2, wherein the oil separation member further has a third inclined surface, the third inclined surface is inclined in a cross section in a radial direction of the oil separation member, and the third inclined surface is higher on an inner side in the radial direction than on an outer side in the radial direction.

5. The scroll compressor according to claim 1, wherein the oil separation member further has a second inclined surface, the second inclined surface has a second inclined surface upstream portion and a second inclined surface downstream portion in the rotational direction, the second inclined surface downstream portion is disposed lower than the second inclined surface upstream portion, and the first fixed leg and the second inclined surface are disposed in order from upstream to downstream in the rotational direction.

6. The scroll compressor according to claim 5, wherein the oil separation member further has a third inclined surface, the third inclined surface is inclined in a cross section in a radial direction of the oil separation member, and the third inclined surface is higher on an inner side in the radial direction than on an outer side in the radial direction.

7. A scroll compressor comprising:

a casing;

a scroll compression mechanism disposed in the casing;

a motor disposed in the casing below the scroll compression mechanism, the motor including a stator and a rotor rotatable in a rotational direction;

a crankshaft connecting the scroll compression mechanism and the motor;

a bearing disposed below the motor, the bearing rotatably supporting the crankshaft;

a frame fixed to the casing, the frame supporting the bearing;

an oil separation member fixed to the frame, the oil separation member being configured to suppress mixing of a refrigerant and a lubricating oil in the casing; and an oil return passage configured to guide the lubricating oil from above the motor to below the motor, the frame having a first fixed leg fixed to the casing and a second fixed leg fixed to the casing, the oil separation member having a first horizontal surface, a first inclined surface, and a second horizontal surface, the first horizontal surface, the first inclined surface, the second horizontal surface, and the first fixed leg being disposed in order from upstream to downstream in the rotational direction, the first inclined surface having a first inclined surface upstream portion and a first inclined surface downstream portion in the rotational direction, the first inclined surface downstream portion being disposed higher than the first inclined surface upstream portion, the first horizontal surface, the first inclined surface, and the first fixed leg being disposed in order from upstream to downstream in the rotational direction, the oil separation member further having a third horizontal surface, the third horizontal surface including an oil return passage portion, the oil return passage portion being located immediately below the oil return passage, and the third horizontal surface and the second fixed leg being disposed in order from upstream to downstream in the rotational direction.

8. The scroll compressor according to claim 7, wherein the stator includes a core cut located on an outer periphery of the stator, and the oil return passage includes the core cut.

9. The scroll compressor according to claim 8, wherein the oil separation member further has a second inclined surface, the second inclined surface has a second inclined surface upstream portion and a second inclined surface downstream portion in the rotational direction, the second inclined surface downstream portion is disposed lower than the second inclined surface upstream portion, and the first fixed leg and the second inclined surface are disposed in order from upstream to downstream in the rotational direction.

10. The scroll compressor according to claim 8, wherein the oil separation member further has a third inclined surface, the third inclined surface is inclined in a cross section in a radial direction of the oil separation member, and the third inclined surface is higher on an inner side in the radial direction than on an outer side in the radial direction.

11. The scroll compressor according to claim 8, wherein the first inclined surface upstream portion and the first inclined surface downstream portion are separated from each other by a first height difference, the first inclined surface upstream portion and the first inclined surface downstream portion are separated from each other by a first circumferential distance in a circumferential direction, the first fixed leg has a first fixed leg upper surface, the second horizontal surface and the first fixed leg upper surface are separated from each other by a second height difference, the second horizontal surface extends in the circumferential direction by a second circumferential distance, and a first inclination ratio of the first height difference to the first circumferential distance is larger than a second inclination ratio of the second height difference to the second circumferential distance.

12. The scroll compressor according to claim 11, wherein the second inclination ratio is at least 0.3 and no more than 1.0.

13. The scroll compressor according to claim 11, wherein the oil separation member further has a second inclined surface, the second inclined surface has a second inclined surface upstream portion and a second inclined surface downstream portion in the rotational direction, the second inclined surface downstream portion is disposed lower than the second inclined surface upstream portion, and the first fixed leg and the second inclined surface are disposed in order from upstream to downstream in the rotational direction.

14. The scroll compressor according to claim 11, wherein the oil separation member further has a third inclined surface, the third inclined surface is inclined in a cross section in a radial direction of the oil separation member, and the third inclined surface is higher on an inner side in the radial direction than on an outer side in the radial direction.

15. The scroll compressor according to claim 11, wherein the first inclination ratio is at least 0.5 and no more than 2.0.

16. The scroll compressor according to claim 15, wherein the second inclination ratio is at least 0.3 and no more than 1.0.

17. The scroll compressor according to claim 7, wherein the oil separation member further has a second inclined surface, the second inclined surface has a second inclined surface upstream portion and a second inclined surface downstream portion in the rotational direction, the second inclined surface downstream portion is disposed lower than the second inclined surface upstream portion, and the first fixed leg and the second inclined surface are disposed in order from upstream to downstream in the rotational direction.

18. The scroll compressor according to claim 7, wherein the oil separation member further has a third inclined surface, the third inclined surface is inclined in a cross section in a radial direction of the oil separation member, and the third inclined surface is higher on an inner side in the radial direction than on an outer side in the radial direction.

19. A scroll compressor comprising:

a casing;

a scroll compression mechanism disposed in the casing;

a motor disposed in the casing below the scroll compression mechanism, the motor including a stator and a rotor rotatable in a rotational direction;

a crankshaft connecting the scroll compression mechanism and the motor;

a bearing disposed below the motor, the bearing rotatably supporting the crankshaft;

a frame fixed to the casing, the frame supporting the bearing; and an oil separation member fixed to the frame, the oil separation member being configured to suppress mixing of a refrigerant and a lubricating oil in the casing, the frame having a first fixed leg fixed to the casing and a second fixed leg fixed to the casing, the oil separation member having a first horizontal surface, a first inclined surface, and a third inclined surface, the first inclined surface having a first inclined surface upstream portion and a first inclined surface downstream portion in the rotational direction, the first inclined surface downstream portion being disposed higher than the first inclined surface upstream portion, the first horizontal surface, the first inclined surface, and the first fixed leg being disposed in order from upstream to downstream in the rotational direction, the third inclined surface being inclined in a cross section in a radial direction of the oil separation member, and the third inclined surface being higher on an inner side in the radial direction than on an outer side in the radial direction.

* * * * *